US009107526B2

(12) United States Patent
Rife

(10) Patent No.: US 9,107,526 B2
(45) Date of Patent: Aug. 18, 2015

(54) ADJUSTABLE ACCESSORY HOOK AND METHOD OF USE

(71) Applicant: Michael J. Rife, Sparks, NV (US)

(72) Inventor: Michael J. Rife, Sparks, NV (US)

( * ) Notice: Subject to any disclaimer, the term of this patent is extended or adjusted under 35 U.S.C. 154(b) by 0 days.

(21) Appl. No.: 14/269,079

(22) Filed: May 3, 2014

(65) Prior Publication Data

US 2014/0339386 A1 Nov. 20, 2014

Related U.S. Application Data

(60) Provisional application No. 61/823,379, filed on May 14, 2013.

(51) Int. Cl.
*A47B 96/00* (2006.01)
*A47G 29/08* (2006.01)

(52) U.S. Cl.
CPC ..... *A47G 29/083* (2013.01)

(58) Field of Classification Search
USPC ..... 248/95, 211, 215, 227.1, 231.41, 303, 248/228.3, 304, 914; 24/568
See application file for complete search history.

(56) References Cited

U.S. PATENT DOCUMENTS 742,417 A * 10/1903 Hammarstrom ..... 24/716
1,532,688 A * 4/1925 Feuerstein ..... 248/229.12
2,457,290 A * 12/1948 Welsh ..... 211/65
2,634,937 A * 4/1953 Welsh ..... 248/211
2,673,057 A * 3/1954 Morris, Sr. ..... 248/311.2
2,701,883 A * 2/1955 De Fazio ..... 5/503.1
2,784,423 A * 3/1957 Droeger et al. ..... 5/503.1
2,923,514 A * 2/1960 Showers ..... 248/211
3,396,929 A * 8/1968 Brown ..... 248/211
3,476,341 A * 11/1969 Patterson ..... 248/95
3,664,626 A * 5/1972 Sneller ..... 48/224.7
3,979,097 A * 9/1976 Balne ..... 248/211
4,019,707 A * 4/1977 Quinn et al. ..... 248/95
4,301,767 A * 11/1981 Willinger et al. ..... 119/245
4,949,924 A * 8/1990 Carmody ..... 248/215
5,173,181 A * 12/1992 McFarland ..... 210/167.19
5,368,267 A * 11/1994 Howard ..... 248/231.41
5,582,377 A * 12/1996 Quesada ..... 248/229.12
5,687,941 A * 11/1997 Quintile ..... 248/210
5,738,319 A * 4/1998 Grassi ..... 248/215
5,822,918 A * 10/1998 Helfman et al. ..... 47/39
6,062,703 A * 5/2000 Tsao ..... 362/184
6,250,595 B1 * 6/2001 Campbell ..... 248/211
6,398,174 B1 * 6/2002 Emalfarb ..... 248/214
6,471,170 B2 * 10/2002 Pook ..... 248/215
6,481,680 B2 * 11/2002 Neuman ..... 248/227.2

(Continued)

*Primary Examiner* — Bradley Duckworth
(74) *Attorney, Agent, or Firm* — John D. Long, Esq; Long & Chybik

(57) ABSTRACT

The invention could be an adjustable accessory hook comprising a first L-shaped attachment member comprising a hook, a first rectangular plate connected by a first common end to a second rectangular plate in a perpendicular orientation, the second rectangular plate further having a lengthwise channel, a hook for supporting container-based carry means that projects outward and away from the first L-shape attachment member; a second L-shaped attachment member having a first rectangular sheet connected to a second rectangular sheet by a second common end in an non-planar manner; a locking mechanism that passes through the lengthwise channel to adjustably attach the second L-shaped attachment member to the first L-shaped attachment to adjustably form a C-shaped opening into which a portion of an edge of a horizontal support surface can be removably received and secured.

17 Claims, 3 Drawing Sheets

(56) References Cited

U.S. PATENT DOCUMENTS

| | | | | |
|---|---|---|---|---|
| 6,543,737 | B2 * | 4/2003 | Decker et al. | 248/316.1 |
| 7,175,143 | B1 * | 2/2007 | Ho | 248/215 |
| 7,648,111 | B2 * | 1/2010 | Goldstein | 248/261 |
| 7,735,800 | B2 * | 6/2010 | Lunato et al. | 248/558 |
| 7,992,833 | B1 * | 8/2011 | Goodman et al. | 248/298.1 |
| 8,157,677 | B1 * | 4/2012 | Chen | 473/490 |
| 2013/0074294 | A1 * | 3/2013 | Lynch | 24/535 |

* cited by examiner

ADJUSTABLE ACCESSORY HOOK AND METHOD OF USE

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention relates to adjustable accessory holders that are removably secured to horizontal support surfaces to allow the adjustable accessory holders to support purses, handbags, computer cases, carrying bags and the like proximate to the respective horizontal support surface. More particularity to those adjustable accessory holders that have a capacity to adjust their attachment mechanisms to accommodate variations in the thickness of the various horizontal support surfaces to which the adjustable accessory holder may be attached.

BACKGROUND

Various public places, such restaurants, libraries, bars, restrooms, may provide tables, counters, tabletops and the like (e.g., horizontal support surfaces) for use by their patrons. The patrons, in using such the horizontal support surfaces, may have with them various accessories such as handbags, purses, backpacks, computer cases, carrying bags and other container-based carrying means that they need to be secured as they use the tables. Sometimes, securing these container-based carrying means may be accomplished by placing them upon the tables (generally frowned upon as bad manners in restaurants); on chairs/seats proximate to the tables or underneath the tables themselves. These solutions may result in taking up needed space on the table/accompanying chair(s), the soiling of the container-based carrying means when placed upon the floor, allowing the unwanted tampering by third persons (e.g., theft) when the carrying means may be located outside of the view of the patron.

What could be needed is an adjustable accessory hook that can removably attach to the horizontal support surface. The adjustable accessory hook could provide an attachment means or hook that can be used to removably engage handles, straps, hooks, and the like of the container-based carrying means to substantially place those articles proximate to the horizontal support surface. The adjustable accessory hook could further have the capacity to adapt to different thicknesses of the different horizontal support surfaces of the various tables, counters and alike to which the adjustable accessory hook may be attached.

SUMMARY OF ONE EMBODIMENT OF THE INVENTION

Advantages of One or More Embodiments of the Present Invention

The various embodiments of the present invention may, but do not necessarily, achieve one or more of the following advantages:

providing an adjustable accessory hook forming an adjustable C-shaped opening, which could receive an edge of a horizontal support surface of a table or like and to clasp down upon the edge of that horizontal support surface by adjusting to the thickness of the horizontal support surface;

the ability to secure accessories such a purses, handbags and the like to the horizontal support surface to avoid the accessories from taking up space on the horizontal support surface, being tampered with by third parties, or getting dirty by otherwise being located upon a floor;

providing the adjustable accessory hook that can impart a gripping bias to the horizontal support surface to which the adjustable accessory hook is attached;

the ability to removably attach the adjustable accessory hook to horizontal support surfaces having different thicknesses;

providing the adjustable accessory hook wherein a hook is formed from the structure of the adjustable accessory hook; and the ability to slide and lock parts of the adjustable accessory hook to form a C-shaped opening that can accept a portion of an edge of the horizontal support surface.

These and other advantages may be realized by reference to the remaining portions of the specification, claims, and abstract.

Brief Description of One Embodiment of the Present Invention

One possible embodiment of the invention could be an adjustable accessory hook comprising a first L-shaped attachment member having a first rectangular plate connected by a first common end to a second rectangular plate in a perpendicular orientation, the second rectangular plate further having a lengthwise channel, and a hook that projects outward and away from the first L-shaped attachment member; a second L-shaped attachment member having a first rectangular sheet connected to a second rectangular sheet by a second common end in an non-planar manner; and a locking mechanism that passes through the lengthwise channel and the second L-shaped attachment member to adjustably attach the second L-shaped attachment member at a position along the lengthwise channel so that the first rectangular plate and the first rectangular sheet can oppose one another to form a C-shaped opening that removably receive a portion of an edge of a horizontal support surface.

Another possible embodiment of the invention could be a method or process for operating an adjustable accessory hook comprising of the following steps: providing an adjustable accessory hook comprising of a first L-shaped attachment member, a second L-shaped attachment member and a locking mechanism, the first L-shaped attachment member having a lengthwise channel and a hook, the second L-shaped attachment member have a locking aperture, the locking mechanism penetrating both the lengthwise channel and the locking aperture to bring the first and second L-shaped attachment members together to form a C-shaped opening having an adjustable width; providing a horizontal support surface having an edge connecting a top and a bottom; inserting a portion of the edge within the C-shaped opening; and engaging the locking mechanism to bring the first and second L-shaped attachment members into contact with the portion in a manner that counters a detachment force exerted by a weight of one or more objects that engage the hook.

Still yet another possible embodiment of the invention could be a combination of an adjustable accessory hook as supported by a horizontal support surface comprising: an adjustable accessory hook having a locking mechanism that adjustably attaches a first L-shaped attachment member to a second L-shaped attachment member to form a C-shaped opening, the locking mechanism and the second L-shaped attachment member slide along a portion of the first L-shaped attachment member to adjust the width of the C-shaped opening, the first L-shaped attachment member further providing a hook to support one or more objects; a horizontal support structure held in a horizontal orientation relative to a ground, the horizontal support structure having an edge that connects a top to a bottom; wherein a portion of the edge is placed within the C-shaped opening to allow the locking mechanism to compress the first and second L-shaped attachment members against the portion in a manner that counteracts a force exerted by the weight of one or more objects that engage the hook.

The above description sets forth, rather broadly, a summary of one embodiment of the present invention so that the detailed description that follows may be better understood and the contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
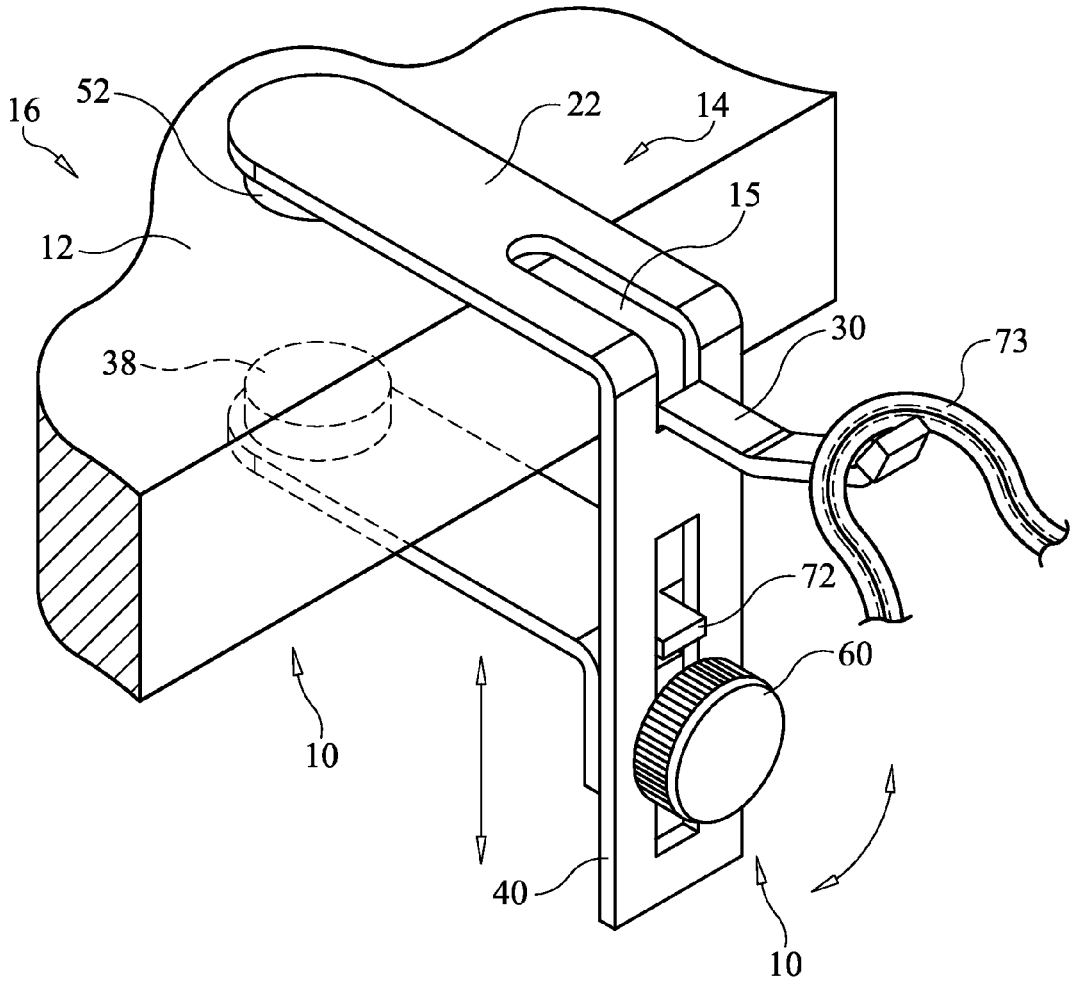
FIG. 1 is substantially a cutaway perspective view of one embodiment of the present invention as it is attached to a horizontal support surface.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present invention 10 could comprise of an adjustable accessory hook 20 and a method for its use 200. As substantially shown in FIG. 1, the horizontal support surface 12 to which the invention 10 be applied can be a planar element as generally found in tables, counters, table tops, desks, cabinet, and the like that has an edge 14, which connects a top 16 and a bottom 18. The horizontal support surface 12 is accordingly lifted off and held away from a ground or floor (not shown) generally by some structure (e.g., table, counter, etc.) and substantially held in a horizontal orientation relative to the ground or floor. A portion 15 of the edge 14 is generally what the invention 10 partially encompasses to removably affixed itself to the horizontal support surface 12.

To accomplish this attachment, the adjustable accessory hook 20 could comprise of a first L-shaped attachment member 22 movably connected to a second L-shape attachment member 40 by a lock mechanism 60 to generally form a C-shaped opening 38 for removably receiving a portion 15 of the edge 14. The first L-shaped attachment member 22 can further form and support a hook 30 to which straps, handles and other connectors 73 of objects and accessories (e.g., container-based carrying means such as purses, handbags, backpacks, computer bags, and the like) of the operator (not shown in the figures) can be hung to bring those objects or accessories proximate to the horizontal support surface 12 to which the invention 10 is attached. The two L-shape attachment members 22, 40 could be made from suitable material such as steel as is known by those skilled in the art and could be further powder coated to increase the invention's presentation as well as provide a surface that would not otherwise be abrasive or damaging to the horizontal support surface 12.

Figure 2:
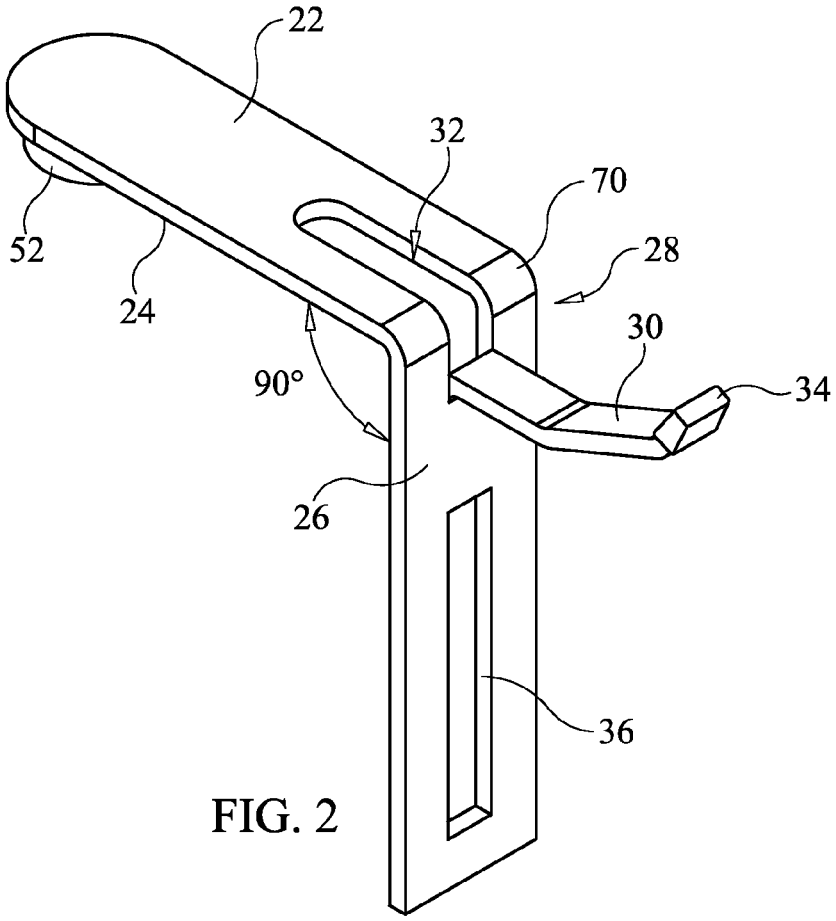
FIG. 2 is substantially a cutaway view of one embodiment of the first L-shaped attachment member of the present invention.

As substantially shown in FIG. 2, the first L-shaped attachment member 22 could be a first rectangle plate 24 connected by a first common end 70 to a longer second rectangular plate 26 in a non-planar relationship. The first L-shaped attachment member 22 could be formed by a first rectangle plate 24 connected by a first common end 70 to a longer second rectangular plate 26. A long U-shaped cut 28 reaching out to a midsection of the first rectangular plate 22 and terminating at the top of the second rectangular plate 24 could further define a section of the first L-shaped attachment member 22 that can pulled away from the second rectangular plate 26 with a series of folds imparted to the section to form a hook 30 that generally projects perpendicularly away from the second rectangular plate 26. The plate aperture 32 created by the formation of the hook 30 can further allow the operator (not shown) to see the edge 14 (as substantially shown in FIG. 1) as partially encompassed by the adjustable accessory hook 20 to ensure the invention 10 is properly seated upon the edge 14.

To promote safety, a portion of the hook 30 could be covered or coated with an elastic polymer 34 or alike to limit the likelihood that any present sharp hook edge(s) may damage the hung accessories or the operator. This coating 34 along with the folded or curled shape of the hook 30 may further help reduce the likelihood of impalement by the invention 10 should an individual (not shown) fall against the invention 10 when employed upon a horizontal support surface 12 (substantially shown in FIG. 1.)

The second rectangular plate 26 could further have a lengthwise channel 36 running along a portion of its longitudinal midsection. This channel 36 could connect one side of the second rectangular plate 26 to its other side to generally allow the locking mechanism 60 (as substantially shown in FIGS. 1 and 4) to connect the second L-shaped attachment member 40 to the first L-shaped attachment member 22 (as substantially shown in FIGS. 1 and 4) along the lengthwise channel 36 to the form the C-shaped opening 38 (as substantially shown in FIGS. 1 and 4.)

Figure 3:
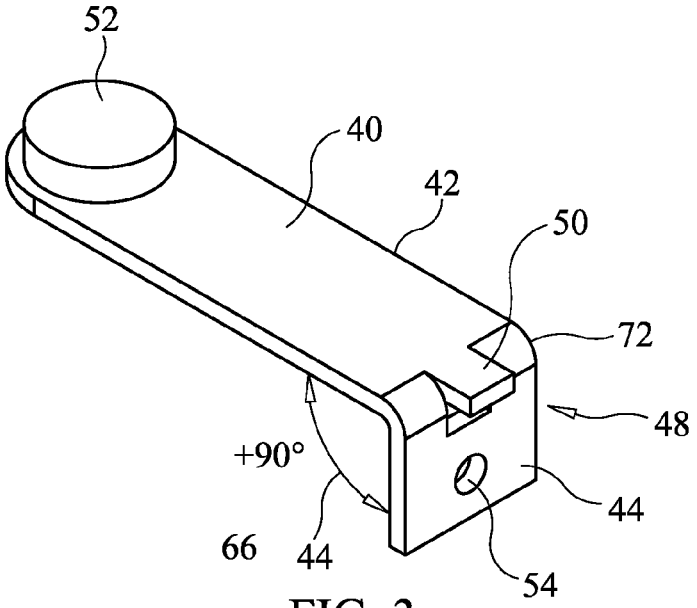
FIG. 3 is substantially a cutaway view of one embodiment of second L-shaped attachment member of the present invention.

As substantially shown in FIG. 3, the second L-shaped attachment member 40 could be formed from a first or long rectangular sheet 42 connected at initially non-planar angle 44 (e.g., to obtuse) to a second or short rectangular sheet 44 by a second common end 72. This initially obtuse angular relationship can allow the second L-shape attachment member 40 when brought against the edge 14 (e.g., the bottom 18) to be initially have a non-parallel relationship with the bottom 18 (vs. the first L-shaped member 22 which may be brought initially flat against the edge [e.g., the top 16]). When the locking mechanism 60 (substantially shown in FIGS. 1 and 2) then engages against the second L-shaped attachment member 40 to lock it in place against the first L-shaped attachment member 22, the second L-shaped attachment member 40 is pressed or biased up against the bottom 18 (e.g. brought under pressure to be generally laid flat against the bottom 18) (as substantially shown in FIG. 1.) In this manner, the angular relationship of the first and second rectangular sheets 42, 46 can move from a substantially obtuse orientation to a substantially perpendicular orientation. This biasing of the first rectangular sheet 42 against the bottom 18 may create a gripping force imparted by both the first and second L-shaped attachment members 22, 40. This gripping force may aid in the retention of the invention 10 upon the edge 14 and generally counter an opposing force/weight imposed by any objects or accessories hanging upon the hook 30 by a strap or handle 73.

Terminating proximate to the common end 72 could be a small U-shaped cut 48 that extends into the short rectangular sheet 46. The small tang 50 created by the small U-shaped cut 48 could be pulled out and away from the second rectangular sheet 46 to be perpendicular to the second rectangular sheet 46 but generally coplanar with the first or long rectangular sheet 42. When the second or short rectangular sheet 46 is held against the first L-shaped attachment member 22 by the locking mechanism 60, this tang 50 could protrude into the lengthwise channel 36 (as substantially shown in FIGS. 1, 2 and 4) and then move along the length of the lengthwise channel 36 as the second L-shaped attachment member 40 moves relative to the first L-shaped attachment member 22 to adjust the width of the C-shaped opening 38. The small tang 50 by protruding into the lengthwise channel 36 and sliding along the length of the channel 36 may help resist rotation of the second L-shaped attachment member 40 relative to the first L-shaped attachment member 22 that may be caused by the activation of the locking mechanism 60. The short rectangular sheet 46 could also be further penetrated by an attachment aperture 54 which allows a portion of the locking mechanism 60 to pass through the short rectangular sheet 46.

In at least one embodiment of the L-shaped attachment members 22, 40, resilient compressible pads 52 (e.g., ones made from rubber) (as substantially shown in FIGS. 1, 2, 3 and 4) could be affixed to their inner tips (the tips or ends that would respectively face the bottom 18 and top 16 of the edge 14 [as substantially shown in FIG. 1]. These pads 52 could help prevent damage to the horizontal support surface 12 as the invention 10 engages it as well as aid the capacity of the invention 10 to grip the horizontal support surface 12 in a manner that counters the force/weight of accessories that are hanging upon the invention 10.

Figure 4:
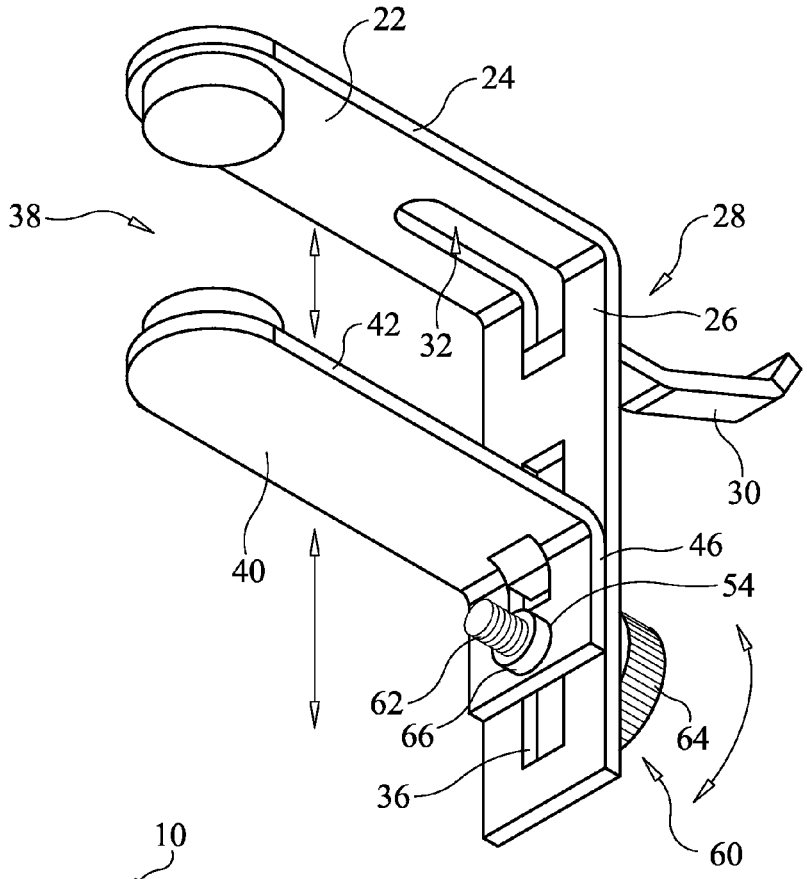
FIG. 4 is substantially a perspective view of one embodiment of locking mechanism holding the first and second L-shaped attachment members together.

As substantially shown in FIG. 4, the locking mechanism 60 for generally securing first L-shaped attachment member 20 to the second L-shaped attachment member 40 to substantially form the C-shaped opening 38 for receiving an edge 14 to secure the invention 10 to a horizontal support surface could comprise of threaded fastener 62 (e.g., screw or bolt) terminated at one end in a serrated knob 64 that is received by a reciprocal annularly-threaded fastener 66 (e.g. a nut) attached to the second or short rectangular sheet 46 at the attachment aperture 54 in coaxial manner. In this manner, the threaded fastener 62 could pass through the lengthwise channel 36 and into the attachment aperture 54/reciprocal annular threaded fastener 66 to movably attach the second L-shaped attachment member 40 (e.g., via the second or short rectangular sheet 46) relative the second rectangular plate 26 of the first L-shaped attachment member 22. The combination of locking mechanism 60/short rectangular sheet 46 (with the small tang 50 to generally prevent unwanted rotation) the second L-shaped attachment member 40 can be moved along (in a generally captive manner) a length of the lengthwise channel 36 of the first L-shaped member 22 to form the adjustable C-shaped opening 38 that can receive a portion of the edge to removably secure the invention 10 to the horizontal support surface. In this manner, the first rectangular plate 24 (e.g., of the first L-shaped attachment member 22) and the long rectangular sheet 42 (e.g., of the second L-shaped attachment member 40) are held in parallel to one another to generally form arms which substantially define the adjustable width of the C-shaped opening 38, while a portion of the second rectangular plate 26 (e.g., of the first L-shaped attachment member 22) denotes the back of the C-shaped opening 38.

Figure 5:
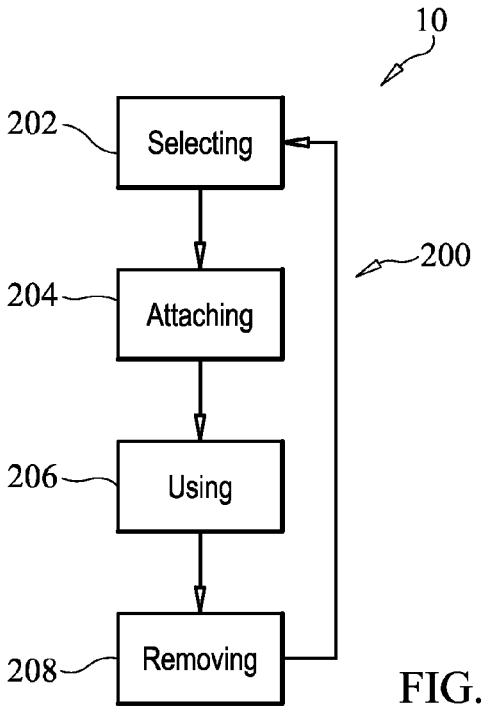
FIG. 5 is substantially a flow chart of one embodiment of a process or method of using the present invention.

As substantially shown in FIG. 5, one possible process or method 200 of operating the invention 10 could commence with step 202, selecting a suitable horizontal support surface. The operator could select which horizontal support surface (e.g., as provided by tables, counters, table tops, desks, and alike) that have suitable edges that connect a top (surface) with a bottom (surface) to which the invention 10 may be attached. The operator could observe and generally estimate the thickness (distance between the top and bottom of the horizontal surface.) After the substantial completion of the step 202, the process 200 could procedure to step 204, attaching the invention.

In step 204, attaching the invention, the operator could loosen the locking mechanism so that the second L-shaped attachment member can move by its second or short rectangular sheet along the second rectangular plate (e.g., along the length of the lengthwise channel) until the C-shaped opening is wide enough to accommodate the thickness of the edge of desired horizontal support surface. The adjustable accessory hook is then applied to the desired portion of the edge, which is received between the first rectangular plate and the first or long rectangular sheet until the portion touches against the second or short rectangular sheet (as generally seen through the plate aperture.) The operator can then manually bring the first rectangular plate and the first or long rectangular sheet up against the respective top and bottom of the portion. When the first or long rectangular sheet is brought up to rest against the bottom, generally the second or short rectangular sheet does not initially lie flat against the second rectangular plate but there exists some play between the two (as connected together by the locking mechanism) substantially due to the initial obtuse angular relationship between the first or long rectangular sheet as it connects to the second or short rectangular sheet. As the locking mechanism is activated to tighten the second or short rectangular sheet to the second rectangular plate, the obtuse angular relationship biases the long rectangular sheet to press against the bottom. This locking action changes the obtuse angular relationship or orientation to a perpendicular orientation to establish the invention 10 with a significant gripping force to retain the portion in a manner that otherwise counters or resists other disengaging force(s) as generated by the weights of objects and accessories attached to the hook. As the locking mechanism is fully tightened, the tang otherwise prevents the rotation of the second small rectangular sheet relative to the second rectangular plate that may occur as the threaded fastener is rotated relative to the small rectangular sheet. Once the locking mechanism has secured the second L-shaped attachment member in place to first L-shaped attachment member, the process 200 can proceed to step 206, using the device.

In step 206, using the device, the operator can hang various objects accessories (e.g., container-based carrying objects such as purses, bags, laptop cases, backpacks, etc.) by their respective straps, loops, hooks, etc. upon the hook. By keeping the objects and accessories to proximate to the operator (who may be using the horizontal support surface) and off the floor, the invention 10 may keep the accessories from experiencing excessive wear and tear, dirt and possible third party tampering (e.g., theft). The invention 10, by generally lifting up the accessories, may make it easier for the operator to access them. After, the operator is substantially done with using the invention 10, the process 200 could proceed to step 208, removing the device.

In step 208, removing the device, the operator can remove any and all objects and accessories from connection with the hook. The locking mechanism can then be deactivated to relieve the biasing caused by the first and second L-shaped attachment members and let the second L-shape attachment member move relative to the first L-shape attachment member to increase the width of the C-shaped opening. In this manner, the invention no longer grasps the portion and can be removed from the horizontal support surface. The process 200 can return to step 202 when the operator once again wants to use the adjustable accessory holder.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As generally described and illustrated hereto, the invention provides a hook for holding accessories proximate to a horizontal support surface. The invention provides an adjustable set of L-shaped attachment members to adjustably define a C-shaped opening that can accept a portion of an edge of a horizontal support surface. The invention may further biases the arms against the horizontal support surface to provide a gripping force that could counter a disengaging weight of accessories being held by the invention.

What is claimed is:

1. An adjustable accessory hook comprising:

a) a first L-shaped attachment member comprising a first rectangular plate, a second rectangular plate and a hook, the first and second rectangular plates are connected together by a first common end in a perpendicular orientation, the second rectangular plate further having a lengthwise channel, the hook projects outward and away from the first L-shaped attachment member;

b) a second L-shaped attachment member comprising a first rectangular sheet connected to a second rectangular sheet by a second common end in a non-planar manner; and c) a locking mechanism that passes through the lengthwise channel and the second L-shaped attachment member to adjustably attach the second L-shaped attachment member to the first L-shaped attachment member so that the first rectangular plate and the first rectangular sheet can oppose one another to form a C-shaped opening capable of removably receiving a portion of an edge of a horizontal support surface;

wherein as the locking mechanism is engaged to attach the adjustable accessory hook to the portion of the edge of the horizontal support surface placed between the first L-shaped member and the second L-shaped member, the locking mechanism will move the first L-shaped member and the second L-shaped member against the portion by changing the non-planar relationship from a first angle orientation that is obtuse to a second angle orientation that is perpendicular.

2. The adjustable accessory hook of claim 1, wherein the first rectangular plate and the second rectangular plate further form a plate aperture through the first common end that allows an operator to see the portion of the edge of the horizontal support surface fully abutting the first common end.

3. The adjustable accessory hook of claim 1 wherein the second L-shaped attachment member has a tab that movably protrudes within the lengthwise channel.

4. The adjustable accessory hook of claim 3 wherein the tab further prevents the second L-shaped attachment member from rotating relative to the first L-shaped attachment member when the locking mechanism is engaged.

5. The adjustable accessory hook of claim 3 wherein the second rectangular sheet moves along a length of the lengthwise channel to adjust a width of the C-shaped opening.

6. The adjustable accessory hook of claim 1 wherein the tip of the hook is curled.

7. A method for operating an adjustable accessory hook comprising the following steps:

a) providing an adjustable accessory hook comprising a first L-shaped attachment member, a second L-shaped attachment member and a locking mechanism, the first L-shaped attachment member having a lengthwise channel and a hook, the second L-shaped attachment member comprises a first rectangular sheet that is connected to a second rectangular sheet by a common end in a non-planar manner, the second rectangular sheet further has a locking aperture, the locking mechanism penetrating both the lengthwise channel and the locking aperture to bring the first and second L-shaped attachment members together to form a C-shaped opening having an adjustable width;

b) providing a horizontal support surface having an edge connecting a top and a bottom;

c) inserting a portion of the edge within the C-shaped opening; and d) engaging the locking mechanism to compress the first L-shaped attachment member and the second L-shaped attachment member against the portion of the edge by changing the non-planar manner from a first angle orientation that is obtuse to a second angle orientation that is perpendicular as the locking mechanism further compresses the second rectangular sheet against the first L-shaped attachment member.

8. The method of claim 7 further comprising a step of penetrating the first L-shape attachment member by the second L-shape attachment member to prevent a rotation of the second L-shaped attachment member relative to the first L-shaped attachment member.

9. The method of claim 8 wherein the step of penetrating further comprises a step of inserting a tang of the second L-shaped attachment member into the lengthwise channel of the first L-shaped attachment member.

10. The method of claim 9 further comprising a step of adjusting the width of the C-shaped opening by moving the tang of the second L-shaped attachment member along a length of the lengthwise channel of the first L-shaped attachment member.

11. The method of claim 7 wherein the inserting a portion of the edge within the C-shaped opening further comprises a step of looking through a plate aperture formed by a common end of the first L-shaped attachment member to see if the portion is properly received within the C-shaped opening.

12. A combination of an adjustable accessory hook as supported by a horizontal support surface comprising:

a) an adjustable accessory hook having a locking mechanism that adjustably attaches a first L-shaped attachment member to a second L-shaped attachment member to form a C-shaped opening, the locking mechanism and the second L-shaped attachment member slide along a portion of the first L-shaped attachment member to adjust a width of the C-shaped opening, the first L-shaped attachment member further providing a hook to support one or more objects, the second L-shape attachment member comprises a first rectangular sheet connected to a second rectangular sheet by a common end in a non-planar manner;

b) a horizontal support structure held in a horizontal orientation relative to a ground, the horizontal support structure having an edge that connects a top to a bottom;

wherein a portion of the edge is placed within the C-shaped opening to allow the locking mechanism to compress the first and second L-shaped attachment members against the portion and to further compress the second rectangular sheet against the first L-shaped attachment member in a manner that changes the non-planar relationship from a first angle orientation that is obtuse to a second angle orientation that is perpendicular.

13. The combination of claim 12 wherein the hook is cut from the first L-shaped attachment member in a manner that forms a plate aperture that allows an operator to see through the first L-shaped attachment member to observe a position of the portion as received within the C-shaped opening.

14. The combination of claim 12 wherein the locking mechanism is a threaded rod that terminates at one end with a serrated knob, the threaded rod passes through a lengthwise channel in the first L-shaped attachment member to removably attach to a nut attached to the second L-shaped attachment member.

15. The combination of claim 12 wherein the second L-shaped attachment member moves along a length of a lengthwise channel of the first L-shaped attachment member to adjust the width of the C-shaped opening.

16. The combination of claim 15 wherein the second L-shaped attachment member further has a tab that movably protrudes within the lengthwise channel of the first L-shaped attachment member.

17. The combination of claim 16 wherein the tab further prevents the second L-shaped attachment member from rotating relative to the first L-shaped attachment member when the locking mechanism is engaged.

* * * * *